US006329759B1

(12) United States Patent
Tanaka et al.

(10) Patent No.: US 6,329,759 B1
(45) Date of Patent: Dec. 11, 2001

(54) FIELD EMISSION IMAGE DISPLAY

(75) Inventors: Mitsuru Tanaka; Katsumi Takayama, both of Mobara (JP)

(73) Assignee: Futaba Denshi Kogyo Kabushiki Kaisha, Mobara (JP)

( * ) Notice: Subject to any disclaimer, the term of this patent is extended or adjusted under 35 U.S.C. 154(b) by 0 days.

(21) Appl. No.: 09/501,238

(22) Filed: Feb. 10, 2000

(51) Int. Cl.[7] ..... G09G 3/10

(52) U.S. Cl. ..... 315/169.3; 315/169.1; 345/74; 345/76; 345/77

(58) Field of Search ..... 315/169.3, 169.1, 315/169.2, 169.4; 345/74, 76, 77

(56) References Cited

U.S. PATENT DOCUMENTS 4,193,095 * 3/1980 Mizushima ..... 358/241
5,844,531 * 12/1998 Betsui ..... 345/75
5,898,415 * 4/1999 Hansen et al. ..... 345/74
6,037,918 * 3/2000 Hansen et al. ..... 345/74
6,081,246 * 6/2000 Cathey et al. ..... 345/74

* cited by examiner

*Primary Examiner*—Haissa Philogene
*Assistant Examiner*—Tuyet T. Vo
(74) *Attorney, Agent, or Firm*—Oblon, Spivak, McClelland, Maier & Neustadt, P.C.

(57) ABSTRACT

A field emission image display is provided that can obtain a suitable white balance even when the luminous brightness of fluorescent substances is different. When an image is displayed on a field emission display (FED) panel based on input image data, correction data for correcting image data for each color is previously stored into the look-up table 33 to set properly the white balance in each gray scale of a display image to be displayed on the FED panel. The white balance of a display image to be displayed on the FED panel is nearly maintained to a constant value by correcting image data to be input using the correction data stored in the look-up table 33.

2 Claims, 10 Drawing Sheets

FIELD EMISSION IMAGE DISPLAY

BACKGROUND OF THE INVENTION

1. Field of the Invention

The present invention relates to a field emission image display. Particularly, the present invention relates to a display device suitable to field emission color displays.

2. Description of the Prior Art

When the electric field applied to the surface of a metal or semiconductor becomes about $10^9$ volts/m, electrons pierce the barrier based on the tunnel effect and are emitted into a vacuum even at room temperatures. This phenomenon is called field emission. The cathode that emits electrons based on the principle is called a field emission cathode.

Recently, area field emission elements, each of which is formed of an array of micron-size field emission elements (hereinafter merely referred to as FEC), have been able to be produced by fully using the semiconductor fabrication technique. Field emission displays (hereinafter referred to as FEDs), each which uses FECs as an electron emission source, are being developed.

FIG. 7 is an explanatory diagram schematically illustrating a flat color FED using area field emission cathodes.

Referring to FIG. 7, aluminum stripe-like cathode electrodes 102 are vapor deposited on a glass cathode substrate 101. A large number of cone emitters 105 are formed on the cathode electrodes. An insulating layer 103 of silicon dioxide (SiO2) is formed on the area where emitters 105 are not formed. Gate electrodes 104 are formed on the insulating layer 103. Openings are formed in the insulating layer 103 and the gate electrodes 104. Cone emitters 105 are arranged in the openings. That is, the tip of each emitter 105 is viewed from the opening of the gate electrode 104.

The glass anode substrate 110 is disposed so as to confront the cathode substrate 101. Anode electrodes 111 of an ITO (indium-tin-oxide) thin film are formed on the anode substrate 110.

A red (R) fluorescent substance 112, a green (G) fluorescent substance 112, and a blue (B) fluorescent substance 112 are coated on the anode electrodes 111 so as to confront the openings in the gate electrodes 104.

In the color FED with the above configuration, if each gate electrode 104 is shaped in a stripe pattern, the gate electrodes 104 are sequentially scanned and driven line by line. R image data, G image data, and B image data corresponding to a selected line of gate electrodes 104 are supplied to the stripe cathode electrodes 102.

The emitter 105, disposed at an intersection of the cathode electrode 102 and a line of gate electrodes 104 in a driven state, field emits an amount of electrons corresponding to the image data. The emitted electrons impinge the fluorescent substances 112 to 114 arranged at the confronting position to light-emit the corresponding fluorescent substances.

Thus, the gate electrodes are sequentially scanned. When all the gate electrodes 104 are selectively driven, a full color image for one frame is displayed on the anode substrate 110.

In the color FED, the electrons emitted from each cone emitter 105 reach the anode electrode 111 with a divergent angle of about 30. This means that electrons reaching the anode electrode 111 diverge to a certain degree. For that reason, electrons emitted from the emitter 105 light-emit different color fluorescent substances adjacently arranged on the anode electrode 111. This causes the displayed color image to be blurred in color.

In order to solve such a problem, the present applicant proposed the field emission image display that can display a blurless color image by converging electrons emitted from the emitter 105 (refer to Japanese Patent Laid-Open Publication No. Hei 8-298075).

FIG. 8 is a diagram illustrating an arrangement of anode electrodes and cathode electrodes of a FED proposed by the present applicant.

Referring to FIG. 8, the gate electrode 104 is shaped in a patch-like pattern corresponding to one dot. Gate electrodes 104 are arranged in a two-dimensional matrix on the cathode electrode not shown in FIG. 8.

Each of the anode electrodes 111 (shown in chain lines) is a stripe-like anode electrode formed on the anode substrate 110. R, G, and B fluorescent substances are coated on the anode substrate 111 so as to confront the patch-like gate electrodes 104 respectively. In FIG. 8, symbol R, B, or B with each patch-like gate electrode 104 represents the luminous color of a fluorescent substance dot coated on the anode substrate 111.

The stripe-like anode electrodes 111 are connected to anode lead line A1 or A2 every other column.

Two gate lead electrodes are disposed to patch-like gate electrodes 104 of each line, as shown in FIG. 8. For instance, the patch-like gate electrodes 104 corresponding to odd-numbered R, B, and G dots among the patch-like gate electrodes 104 of the first line (row) are connected to the gate lead electrode G1. The patch-like gate electrodes 104 corresponding to the even-numbered R, B, and G dots of the first line are connected to the gate lead electrode G2.

The patch-like gate electrodes 104 corresponding to odd-numbered G, B, and R dots among the patch-like gate electrodes 104 of the second line are connected to the gate lead electrode G3. The patch-like gate electrodes 104 corresponding to the even-numbered R, G, and B dots of the second line are connected to the gate lead electrode G4.

A gate drive voltage is sequentially applied to the gate lead electrodes G1, G2, . . . . For instance, when the gate lead electrode G2 is driven, the even-numbered G, B, and R dots (hatched) of the first line glow.

The image data corresponding to the scanned patch-like gate electrodes 104 is supplied to the cathode electrode in synchronism with the scanning timing of the gate lead electrodes G1, G2, . . . to display an image.

At this time, the potentials of the gate lead electrodes G1, G3 , G4, . . . not driven are set to a level lower than the potential of the driven gate leading electrode G2, preferably to the ground level. Thus, the gate electrodes 104 adjacent to the driven patch-like gate electrode 104 (hatched) are set to a low level. This condition allows electrons emitted from the patch-like gate electrode 104 to be converged to the anode electrode so that the color blurring can be eliminated.

FIG. 9 is a block diagram illustrating the configuration of a drive circuit embodying the method of driving the FED shown in FIG. 8. FIG. 10 is a diagram illustrating the operational timing of the drive circuit.

In FIG. 9, numeral 50 represents a field emission display formed of a matrix of (m×n) pixels. Numeral 51 represents a clock generator that generates clocks synchronized with synchronous signals. Numeral 52 represents a display timing control circuit that controls the display timing with clocks from the clock generators 51. Numeral 53 represents a memory write control circuit that controls to write image data to a video memory 54. Numeral 54 represents a frame memory that stores R image data, G image data, and B image data or a video memory formed of line memories 54-1, 54-2, and 54-3. Each of numerals 55-1, 55-2 and 55-3 represents a buffer register that stores R image data, G image data, and B image data read out of the video memory 54.

Numeral 56 represents an address counter that generates addresses of the video memory 54. Numeral 57 represents a color selection circuit that selects any one of R image data, G image data, and B image data. Numeral 58 represents a shift register that shifts data controlling the gate electrodes 3. Numeral 59 represents a latch circuit that latches data of the shift register 58. Numeral 60 represents a gate driver that drives gate electrodes 59 of the FED 50 according to data from the latch circuit 59. Numeral 61 represents a shift register that shifts image data supplied from the buffer registers 55-1 to 55-3 with shift clocks. Numeral 62 represents a latch circuit that data of the shift register 61. Numeral 63 represents a cathode driver that supplies image data from the latch circuit 62 to cathode electrodes. Numeral 64 represents an anode driver that drives the anode electrode in the FED 50 under control of the display timing control circuit 52.

In the drive circuit, the memory write control circuit 53 controls the write timing of image data. The video memory 54 stores image data for each color in synchronism with the clocks from the clock generator 51. R image data, G image data, and B image data, which are respectively stored in the memories 54-1, 54-2 and 54-3 in the video memory 54, are read out under control of the color selection circuit 57 and based on the address of the address counter 56. The R, G, and B image data read out are respectively saved into the buffer registers 55-1, 55-2, and 55-3.

The color selection circuit 57 controls the output timing of the buffer registers 55-1, 55-2, and 55-3 to supply each image data to the shift register circuit 61. The shift register 61 is shifted with the shift clock S-CLK from the display timing control circuit 52.

When the shift register 61 shifts color data for the pixels corresponding to the number of stripe-like anode electrodes connected to the anode lead electrodes Al (or ½ pixels) among pixels belonging to one line, the latch circuit 62 latches the color data according to the latch pulse from the display timing control circuit 52. The latch circuit 62 supplies the output data to the cathode driver 63.

The display control timing circuit 52 controls the anode driver 64 to apply a positive voltage to only the anode lead electrode Al, as shown in FIGS. 10(*a*) and 10(*b*).

The display timing control circuit 52 supplies the latch pulse as a shift pulse to the shift register 58 and shifts the scan signal supplied from the control circuit 52. The latch circuit 59 latches the output of the shift register 58 in response to the latch pulse and then outputs a scan signal shifted every latch pulse. The scan signal is applied to the gate driver 60.

As a result, the gate driver 60 sequentially applies gate drive voltages to the gate lead electrodes G1, G3, . . . , G2n−1 in the FED 50 to scan them, as shown in FIGS. 10(*c*) to 10(*f*). At this time, the cathode driver 63 supplies image data for R, B, and B, . . . respectively corresponding to the gate lead electrodes G1, G3, . . . , G2n−1 to be driven. When the scanning is sequentially performed to the gate lead electrode G2n−1 of the last line, a half of pixels in one frame are controllably light-emitted.

Next, the display timing control circuit 52 controls the anode driver 64 to apply a positive anode voltage to the anode lead electrode A2. During this period, the display timing control circuit 52 sequentially applies a gate drive voltage to the gate lead electrodes G2, G4, . . . , G to scan them, as shown in FIGS. 10(*g*) to 10(*j*).

In this operation, since the cathode driver 63 supplies image data for G, B, R, . . . corresponding to the gate lead electrodes G2, G4, . . . , G2n to be driven, the remaining pixels of one frame can be controllably light-emitted. When the gate lead electrode G2n of the last line is scanned, the image for one frame can be completely displayed on the FED 50.

In the above-mentioned color FED 50, R, G, and B image data subjected to a pulse width modulation (PWM) are supplied to the cathode driver 63 to obtain a luminous intensity (gray scale). The luminous intensity of a fluorescent substance is roughly proportional to an amount (current) of impinging electrons and a period of impinging time. Generally, those parameters are controlled to determine the luminous intensity (gray scale).

The colors R, G, and B used for the FED 50 are created with different fluorescent substances. For instance, the red (R) fluorescent substance is made of $Y_2O_3$:Eu. The green (G) fluorescent substance is made of $ZnGa_2O_4$, Mn. The blue (B) fluorescent substance is made of $Y_2SiO_5$, Ce. Hence, the electrical to optical conversion characteristics are different among respective fluorescent substances.

FIG. 11 is a diagram illustrating the optical response characteristics of R, G, and B fluorescent substances in pulse wide modulation.

Referring to FIG. 11, the horizontal axis represents data for 64 gray scales ranging 0 to 63. The vertical axis represents brightness ratios of R, G, B, and white (W) colors (brightness ratio in each gray scale when the brightness in gray scale data=63 is defined as 100%).

FIG. 11 shows that even when each of R, G, and B fluorescent substances is driven according to the same drive amount (gray scale data), the brightness ratio, or the luminous efficiency, depends on the fluorescent substance of each color. For that reason, it is difficult that the FED 50 which uses fluorescent substances with a different luminous brightness provides a proper white chromaticity (white balance).

FIG. 11 shows that since the optical response rate of a fluorescent substance for each color depends on the gray scale data, the gray scale display characteristic of a fluorescent substance for each color in the PWM drive operation does not become linear.

For that reason, the problem is that the gray scale characteristic of the white balance does not become linear so that the white balance cannot be kept for each gray scale.

When R, G, or B fluorescent substance is driven to the same drive amount, the luminous amount may be different. In such a case, it is very difficult to reproduce inputted image data with high fidelity.

SUMMARY OF THE INVENTION

The present invention is made to solve the above-mentioned problems.

Moreover, the objective of the invention is to provide a field emission image display wherein a proper white balance can be obtained even when the brightness is different between fluorescent substances and the gray scale characteristic is linear.

The objective of the present invention is achieved by a field emission image display comprising a first substrate on which a plurality of cathode electrodes are formed, each cathode electrode having emitters for field emission; a second substrate on which anode electrodes are formed, three primary color fluorescent substances being coated on the anode electrodes; an image display unit for displaying an image when electrons emitted from the emitters impinge on the three primary color fluorescent substances coated on the anode electrodes; drive means for driving the image display unit; and correction means for correcting image data whereby the white balance of an image displayed on the image display unit is properly set when the drive means drives the image display unit based on the image data.

Moreover, according to the present invention, the correction means comprises a look-up table having correction data which is used to correct the image data to set the brightness level in each gray scale of an image displayed on the image display unit to a predetermined brightness level, or an analog arithmetic circuit for correcting image data.

According to the present invention, correction data, which correct image data for each color, is previously saved into the correction means (look-up table). Thus, the white balance of a display image in each gray scale displayed on the image display unit is corrected when the drive means displays an image on the image display unit based on image data to be input.

BRIEF DESCRIPTION OF THE DRAWINGS

This and other objects, features, and advantages of the present invention will become more apparent upon a reading of the following detailed description and drawings, in which.

DETAILED DESCRIPTION OF THE PREFERRED EMBODIMENT

A field emission image display according to an embodiment of the present invention will be described below with reference to the attached drawings.

Figure 1:
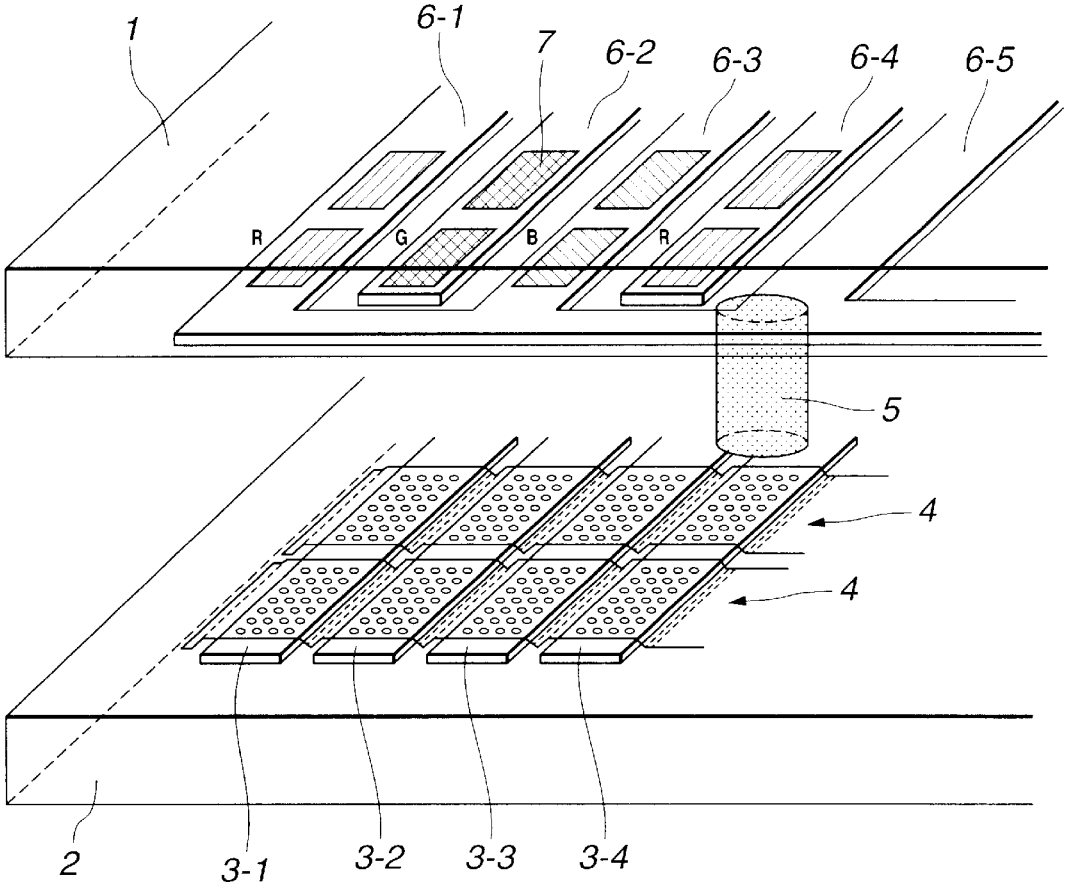
FIG. 1 is a perspective view illustrating a field emission image display according to an embodiment of the present invention.

FIG. 1 is a diagram schematically illustrating the configuration of a color field emission display according to an embodiment of the present invention.

Referring to FIG. 1, numeral 1 represents an anode substrate, 2 represents a cathode substrate, numerals 3-1 to 3-4 represent cathode electrodes, numeral 4 represents a gate electrode, 5 represents a spacer, and 6-1 to 6-5 represents anode electrodes, 7 represents a fluorescent substance dot.

In the color FED with the above-mentioned configuration, the cathode substrate 2 and the anode substrate 1 are disposed so as to confront each other. Field emission cathodes (FEDs) are formed on the cathode substrate 2. Anode electrodes 6-1 to 6-5 are formed on the anode substrate 1. The spacer 5 maintains the gap between the cathode substrate 2 and the anode substrate 1 to a fixed distance. The gap between the fringe of the cathode substrate and the fringe of the anode substrate is sealed with side members (not shown) to maintain the inner space in vacuum. For easy understanding, the gap between the anode substrate 1 and the cathode substrate 2 is magnified in FIG. 1.

Cathode electrodes 3-1 to 3-4 are formed in a stripe pattern on the cathode substrate 2. An insulating layer (not shown) with plural openings therein overlies the cathode electrodes. Cone emitters are formed on the cathode electrodes 3-1 to 3-4 within the openings in the insulating layer. Plural gate electrodes 4, 4, . . . are formed on the insulating layer.

Cathode lead electrodes (not shown) are connected to the cathode electrodes 3-1 to 3-4. In the connection mode, cathode lead electrodes may be respectively connected to the cathode electrodes 3-1 to 3-4. Adjacent cathode electrodes, for example, the cathode electrodes 3-1 and 3-2 may be connected to a single cathode lead electrode.

Figure 8:
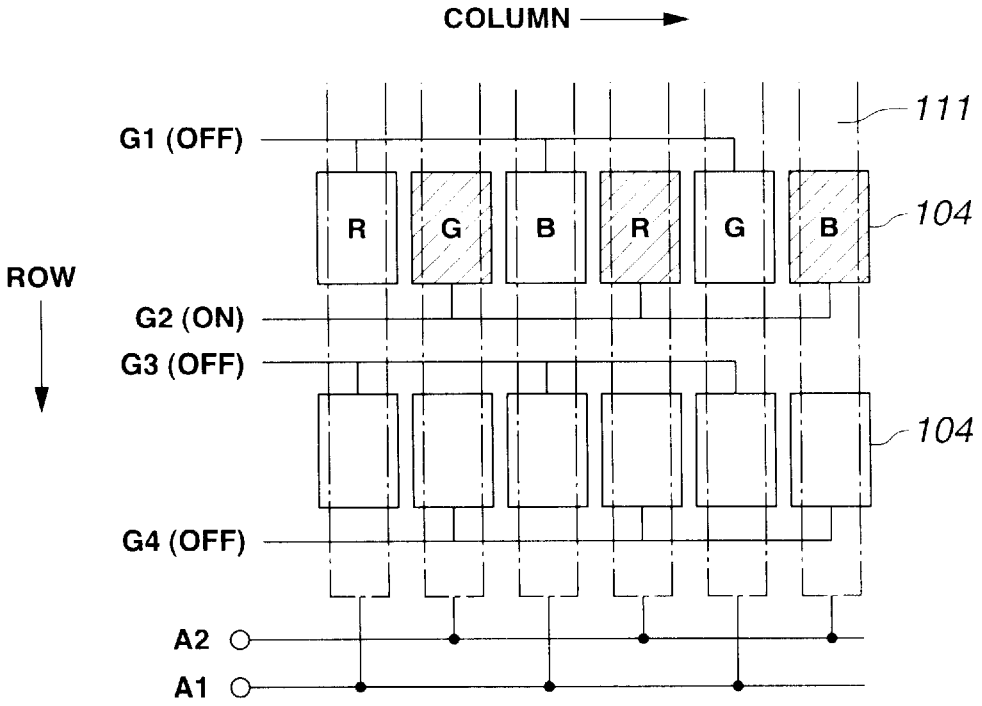
FIG. 8 is a diagram illustrating an arrangement of anode electrodes and gate electrodes in an image display.
Figure 9:
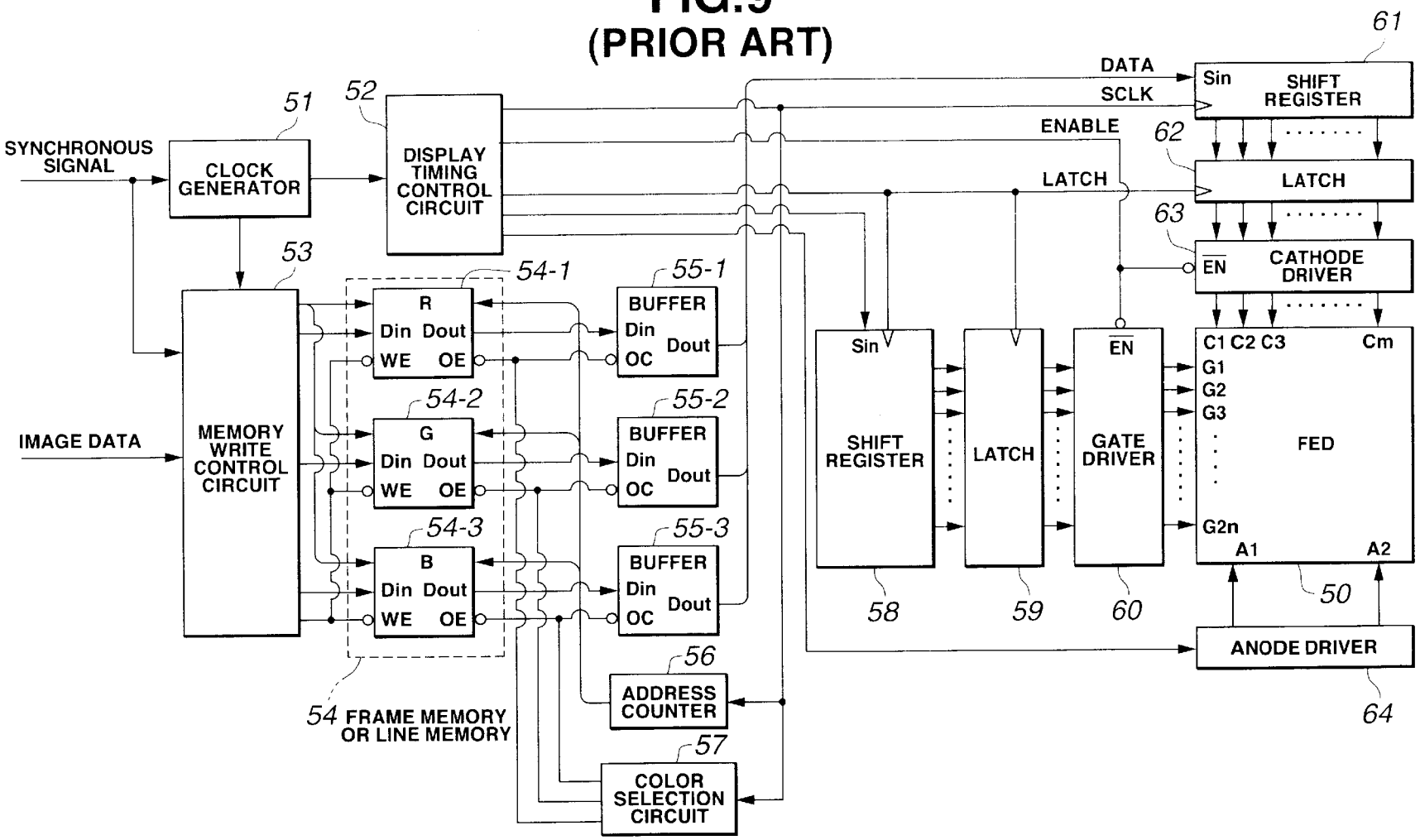
FIG.9 (PRIOR ART)
FIG. 9 is a block diagram of a drive circuit to explain a conventional image display driving method.
Figure 10:
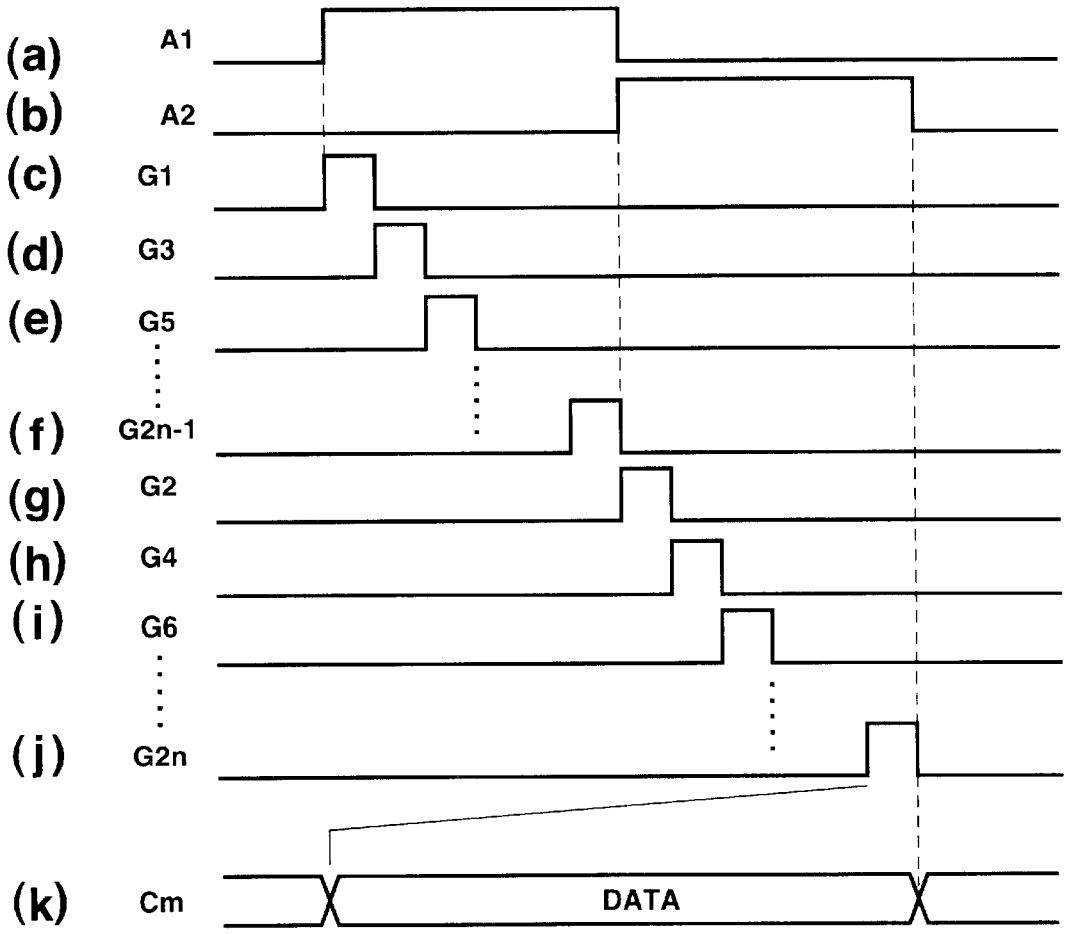
FIG.10 (PRIOR ART)
FIG. 10 is a diagram illustrating timings of various portions of the drive circuit shown in FIG. 9.
Figure 11:
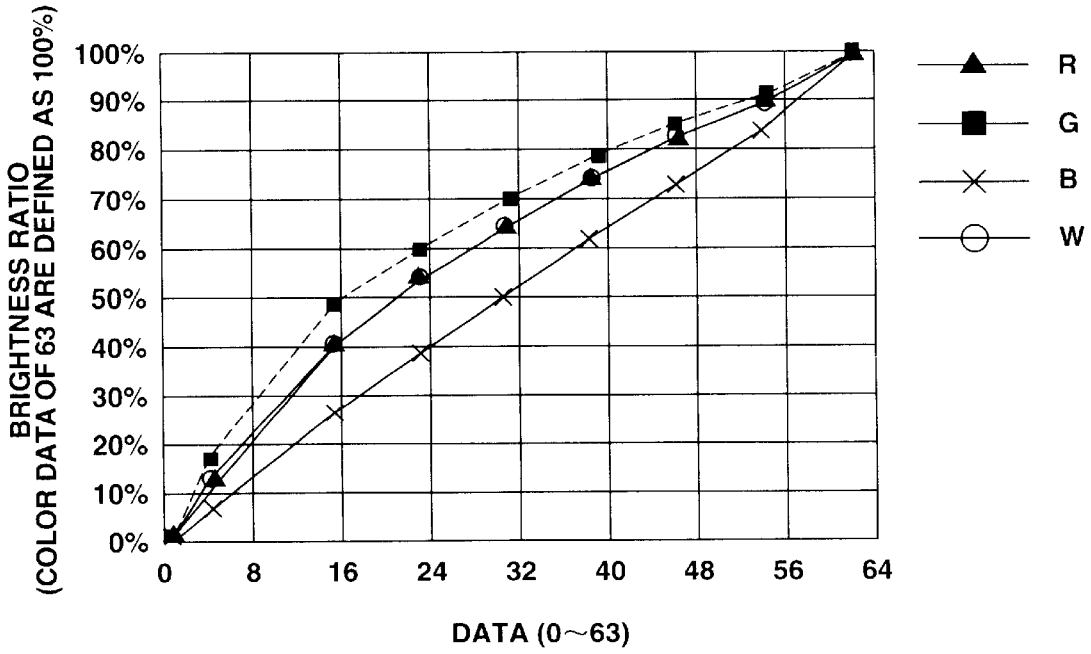
FIG. 11 is a diagram illustrating optical response characteristics to pulse width modulation (PWM) of R, G, and B fluorescent substances.

As already explained with FIG. 8, each gate electrode 4 in a patch-like pattern is formed corresponding to one dot. Plural openings, which respectively correspond to emitter cones within the openings in the insulating layer, are formed on the patch-like gate electrodes 4. Of the patch-like gate electrodes 4 in the direction (elongate direction) perpendicular to the cathode electrode 3, the even-numbered gate electrodes 4 and the odd-numbered patch-like gate electrodes 4 are respectively connected different gate lead electrodes.

On the other hand, transparent anode electrodes 6-1 to 6-5, formed in a stripe pattern, are arranged on the lower surface of a transparent anode substrate 1 and in parallel to the cathode electrodes 3-1 to 3-4 corresponding to gate electrodes 4. One ends of the anode electrodes 6-1, 6-3, 6-5, . . . are connected together. The other ends (not shown) of the anode electrodes 6-2, 6-4, . . . are connected together. That is, the anode electrodes 6 are connected together every other line and in an interdigital pattern.

An ITO (conductive indium-tin-oxide) thin film is used for the anode electrodes 6-1 to 6-5. Plural fluorescent dots 7 are coated on the lower surface of each anode electrode 6-1 to 6-5 and are arranged in an elongate direction and at predetermined intervals. For instance, red (R) fluorescent dots are coated on the anode electrode 6-1. Green (G) fluorescent dots are coated on the anode electrode 6-2. Blue (B) fluorescent dots are coated on the anode electrode 6-3. Three types of R, G, and B fluorescent dots 7 are arranged in turn to configure the display of a color FED.

FIG. 1 shows an example of the configuration of a FED. The patterns of the cathode electrode 3, the gate electrode 4, and the anode electrode 6 are not limited to those in the example. The cathode electrode or anode electrode may be formed in a zigzag pattern.

Figure 2:
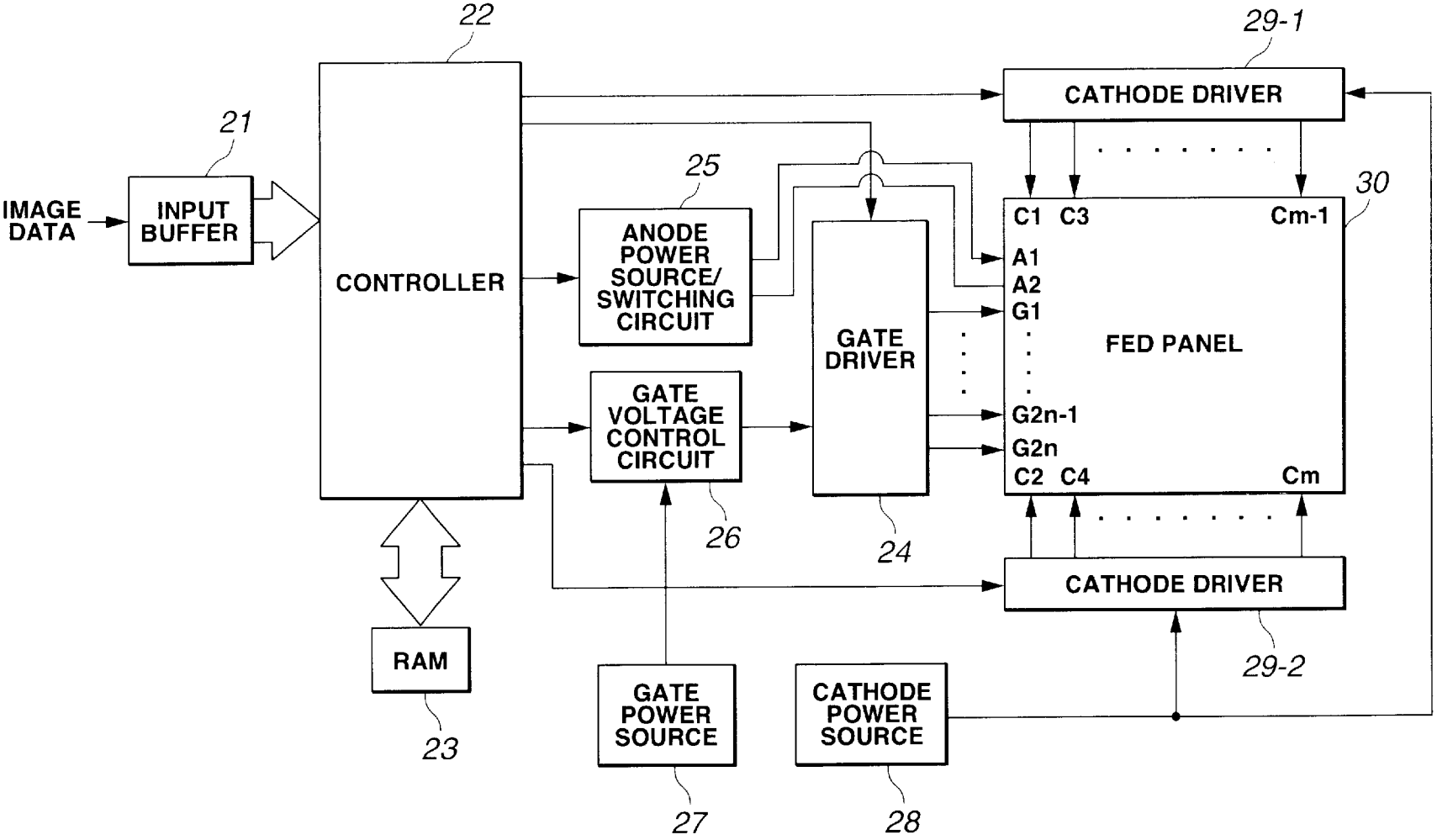
FIG. 2 is a block diagram illustrating a drive circuit to explain the driving method according to the embodiment of the present invention.

FIG. 2 is a block diagram illustrating a circuit module that drives the color FED according to the present embodiment.

Referring to FIG. 2, numeral 30 represents a FED panel including the color FED shown in FIG. 1. Numeral 21 represents an input buffer that holds image data to be input. Numeral 22 represents a controller that implements a predetermined process of image data and controls respective circuit blocks.

Numeral 23 represents a RAM (Random Access Memory) that temporarily stores image data subjected to a predetermined process by the controller 22. Numeral 24 represents a gate driver that drives gate electrodes of the FED panel 30 under control of the controller 22.

Numeral 25 represents an anode power source/switching circuit that selectively drives the anode electrodes of the FED panel 30 under control of the controller 22. The anode power source/switching circuit is formed of an anode power source and a switching circuit. Numeral 26 represents a gate voltage control circuit that controls the gate voltage supplied to the date driver 26 under control of the controller 22. Numeral 27 represents a gate power source that supplies a predetermined voltage to the gate voltage control circuit 26.

Numeral 29 represents a cathode driver that drives the cathode electrodes of the FED panel under control of the controller 22. Referring to FIG. 2, the cathode driver 29 includes a cathode driver 29-1 that controls odd-numbered cathode electrodes and a cathode driver 29-2 that controls even-numbered cathode electrodes. Numeral 28 represents a cathode power source that supplies a predetermined PWM cathode voltage to the source drivers 29-1 and 29-2.

Figure 3:
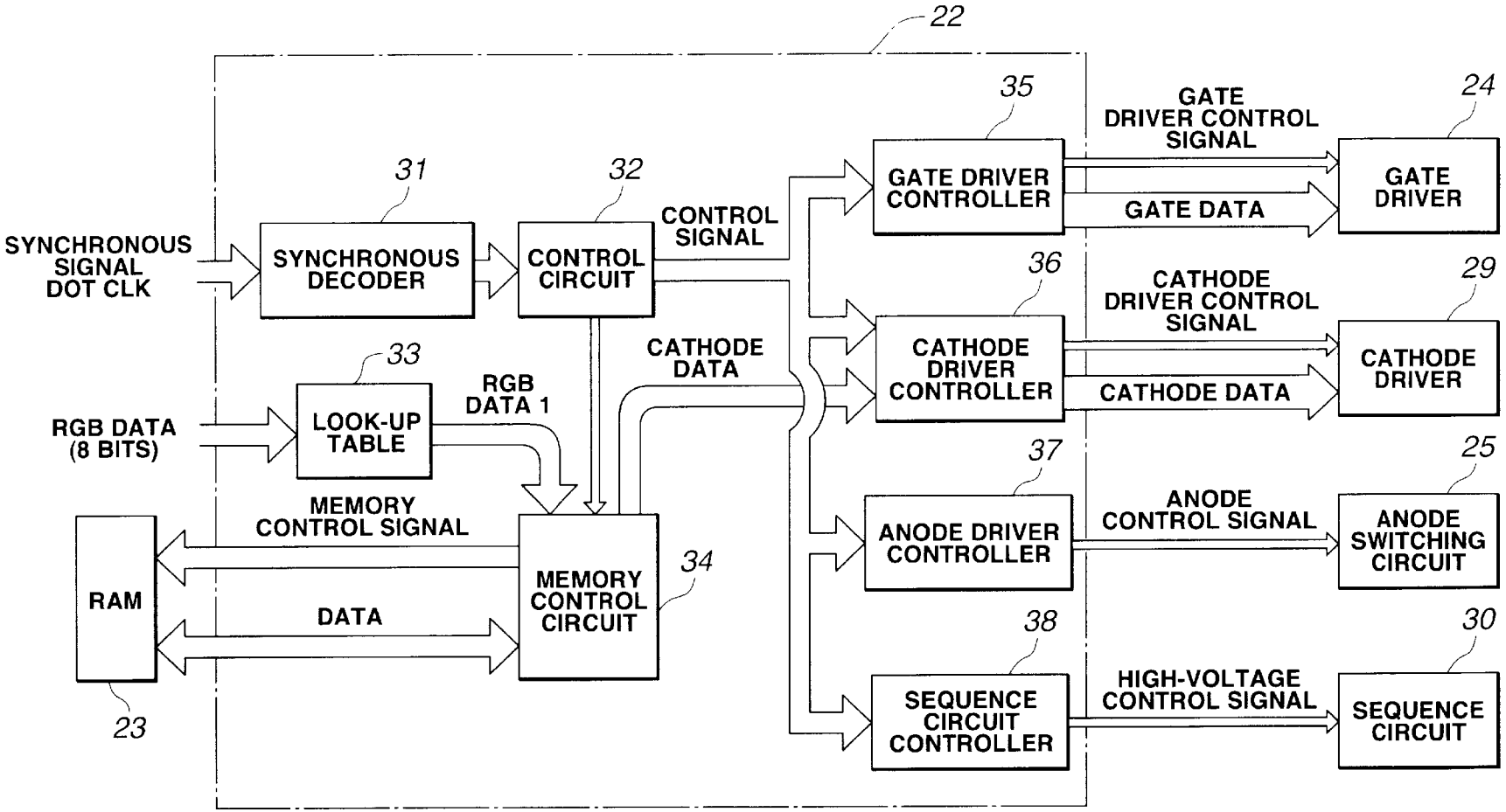
FIG. 3 is a block diagram illustrating the internal configuration of the controller for the drive circuit according to an embodiment of the present invention.

FIG. 3 is a block diagram illustrating the internal configuration of the controller 22 shown in FIG. 2.

The controller 22 shown in FIG. 3 is realized as one-chip including, for example, a gate array.

Referring to FIG. 3, numeral 31 represents a synchronous decoder that decodes the synchronous signal supplied from the input buffer 21 in FIG. 2 or the synchronous signal such as dot clocks (DOT CLK). Numeral 32 represents a control circuit that controls respective circuit blocks based on the control signal from the synchronous decoder 31.

Numeral 33 represents a look-up table that provides a predetermined correction to R, G, or B image data (8 bits) input from the input buffer 21.

The look-up table 33 previously stores correction data corresponding to the characteristics of each of R, G, and B fluorescent substances used for the FED panel 30. Each of 8-bit R image data, 8-bit G image data, and 8-bit B image data (hereinafter referred to as RGB data) is corrected according to the correction data and is converted into the corrected image data (hereinafter referred to as RGB data 1).

In other words, the look-up table 33 corrects the RGB data into the RGB data 1 to set the white chromaticity (white balance) (to be described later) in each gray scale level displayed on the FED panel 30 to a proper value and to linearize the gray scale characteristic.

The correction data stored in the look-up table 33 are determined according to fluorescent substances of respective colors used for the FED panel 30. Hence, predetermined correction data for a fluorescent substance is written to the look-up table 33 at the time of factory adjustment. In another way, by measuring the white chromaticity in each fray scale level at the time of factory adjustment, the resultant correction data may be written in the look-up table 33.

However, in the case of the color display, the luminous brightness of each fluorescent substance does not vary uniformly. For instance, the color balance must be adjusted after 100 hours and after 1000 hours.

In this case, previously assuming the brightness of a luminous color after 100 hours and the brightness of a luminous color after 1000 hours, correction data to adjust the color balance may be stored into the memory. Thus, correction data is changed after a predetermined period of time.

Numeral 34 represents a memory control circuit. The memory control circuit 34 converts the image-corrected RGB data 1 supplied from the look-up table 33 into 6-bit cathode data (gray scale data), based on the control signal from the control circuit 32. Moreover, the memory control circuit 34 executes the memory control of the RAM 23 in which the converted cathode data is written into the RAM 23 or the cathode data is read out of the RAM 23.

Numeral 35 represents a gate driver control unit. The gate driver control unit 35 supplies a gate driver control signal and gate data to the gate driver 24 to control the gate driver 24 that drives the gates of the FED panel 30, based on the control signal from the control circuit 32.

Numeral 36 represents a cathode driver control unit. The cathode driver control unit 36 supplies a cathode driver control signal to the gate driver 24, based on the control signal from the control circuit 32, to control the cathode driver 29 driving cathodes in the FED panel 30. The cathode driver control circuit 36 outputs the 6-bit cathode data supplied from the memory control circuit 34 to the cathode driver 29.

Numeral 37 represents an anode driver controller. The anode driver controller 37 supplies an anode control signal to the anode switching circuit 26 based on the control signal from the control circuit 32 to control the anode switching circuit 26.

Numeral 38 represents a sequence circuit controller. The sequence circuit controller 38 supplies a high voltage control signal to the sequence circuit 30 based on the control signal from the control circuit 32 to control the sequence circuit 30.

Figure 4:
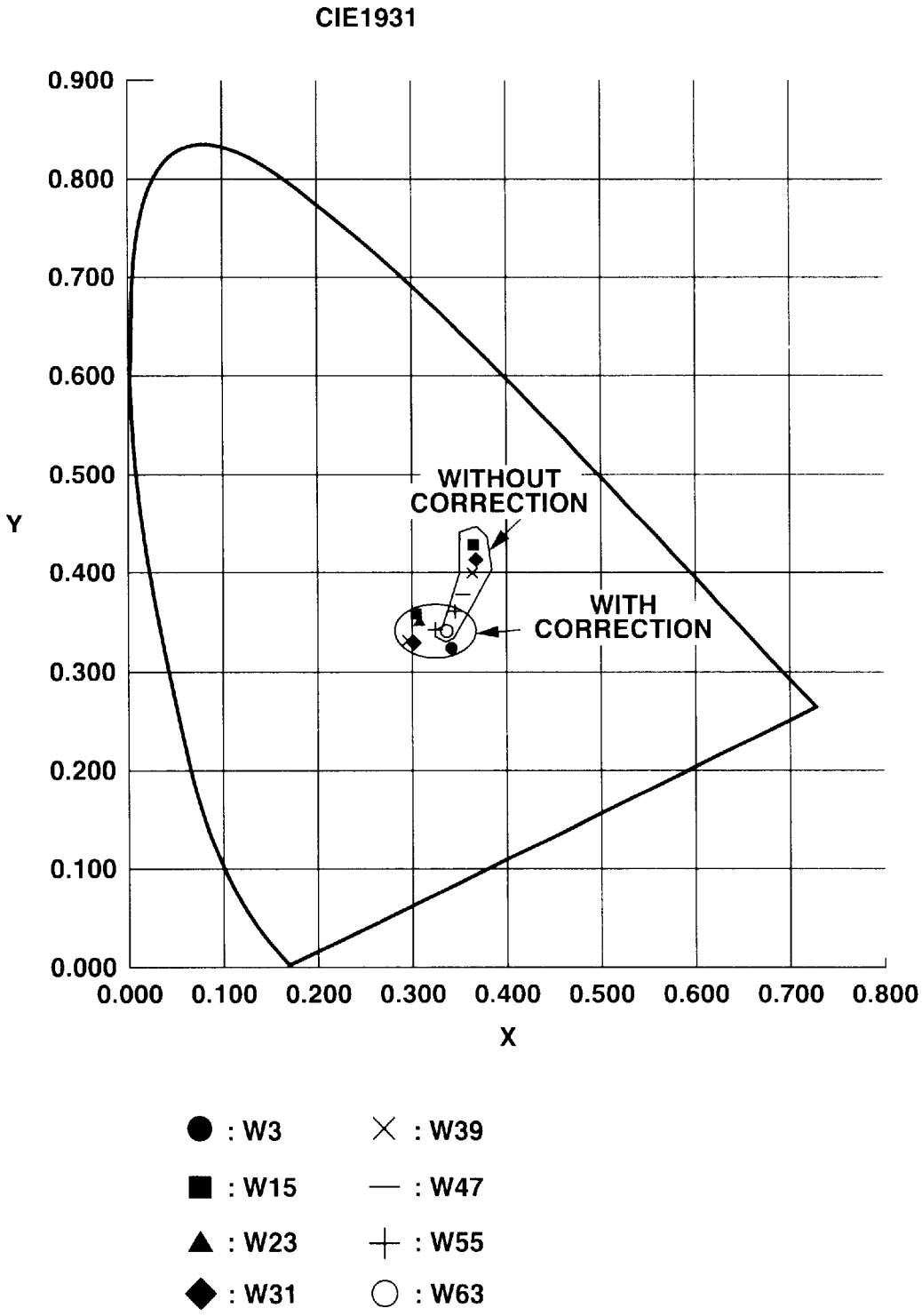
FIG. 4 is a CIE chromaticity diagram illustrating white balances in gray scales before and after correction of a field emission display according to an embodiment of the present invention.
Figure 5A:
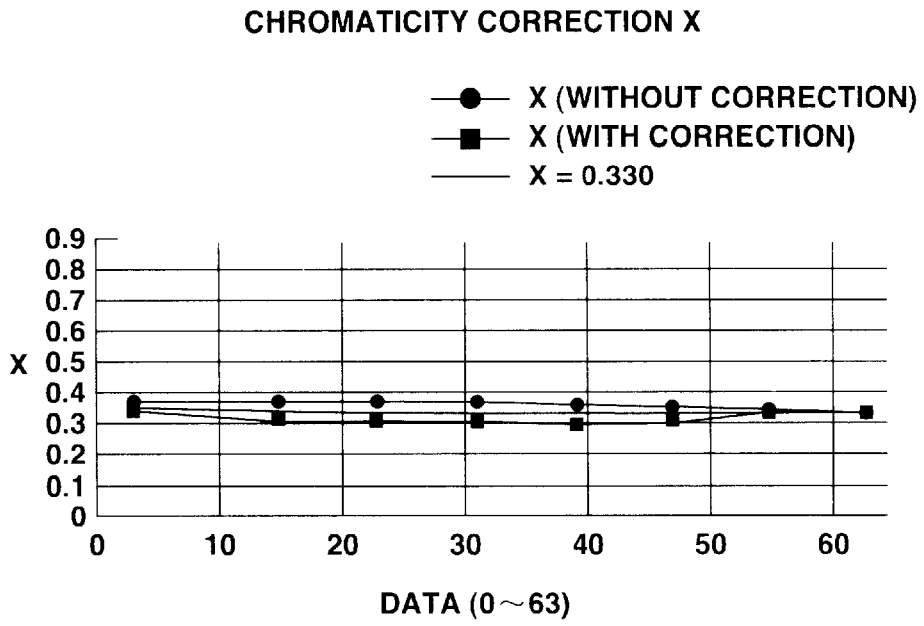
FIG. 5 is a diagram illustrating corrections to gray scale levels in the X-axis direction of the CIE chromaticity diagram shown in FIG. 4.
Figure 5B:
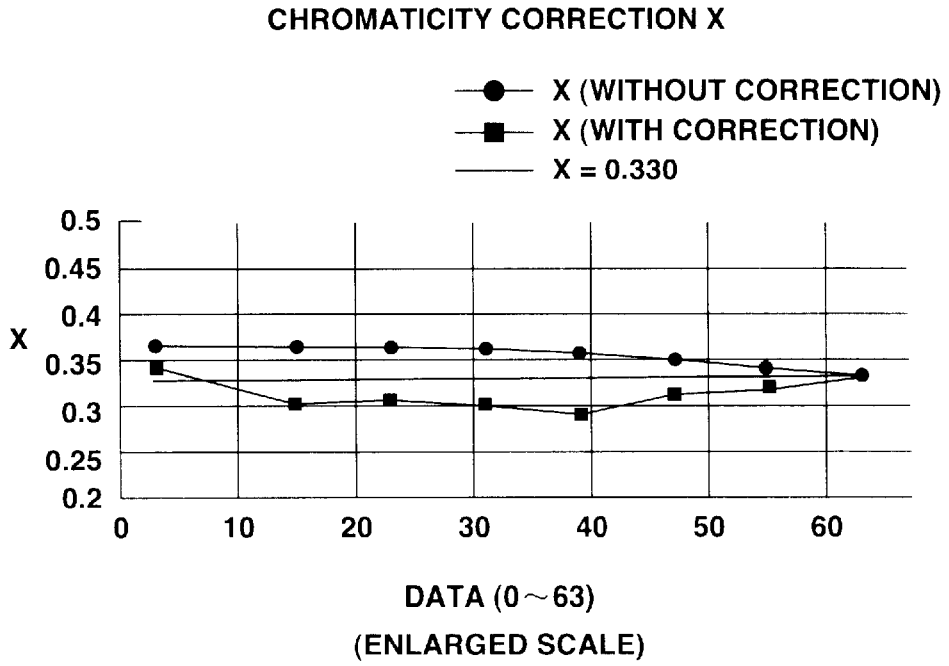
Figure 6A:
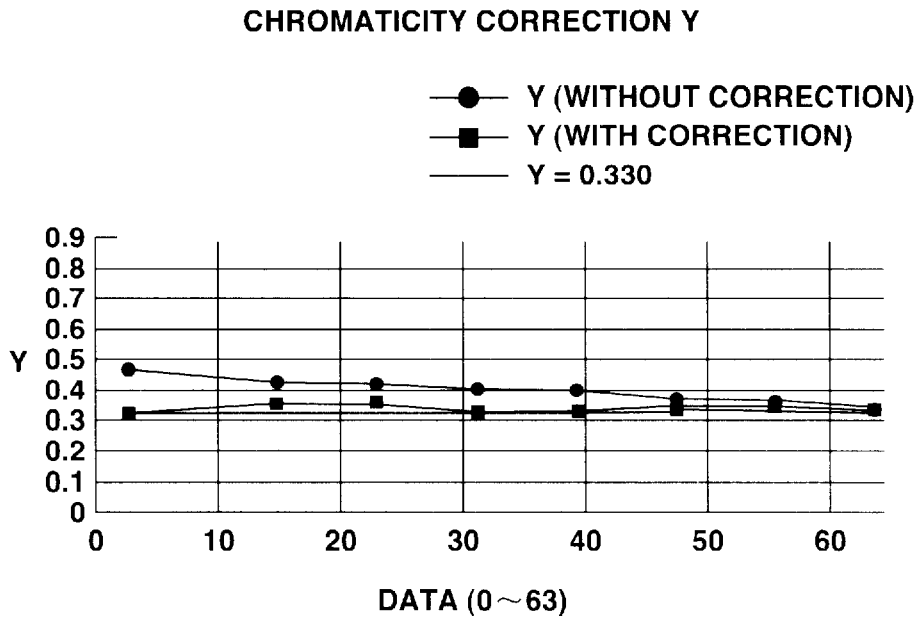
FIG. 6 is a diagram illustrating corrections to gray scale levels in the Y-axis direction of the CIE chromaticity diagram shown in FIG. 4.
Figure 6B:
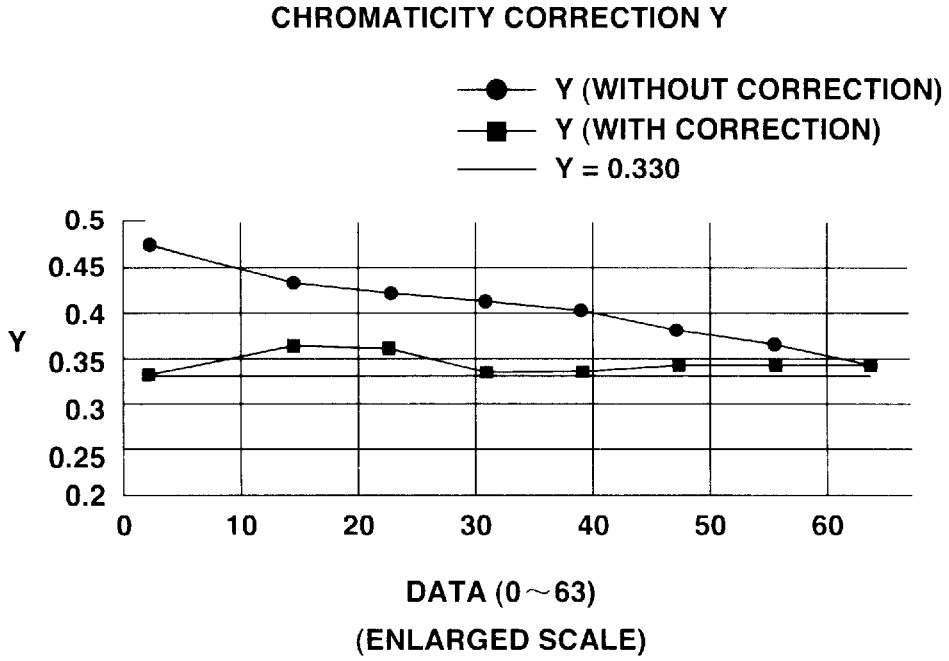
Figure 7:
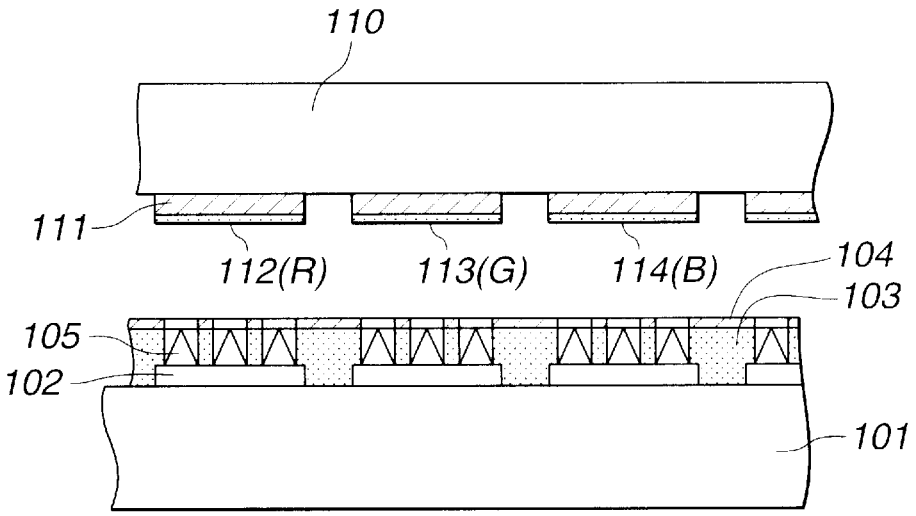
FIG. 7 is a cross sectional view illustrating an image display.

The white balance in each gray scale level before and after correction of the FED according to the present embodiment will be shown in FIGS. 4 to 6.

FIG. 4 is a CIE chromaticity diagram illustrating white balances in gray scale levels before and after correction.

FIG. 5(*a*) is a diagram illustrating corrections in gray scale levels in the X-direction of the CIE chromaticity diagram shown in FIG. 4. FIG. 5(*b*) is an enlarged diagram partially illustrating the correction characteristics of FIG. 5(*a*). FIG. 6(*a*) is a diagram illustrating corrections in gray scale levels in the Y-direction of the CIE chromaticity diagram shown in FIG. 4. FIG. 6(*b*) is an enlarged diagram partially illustrating the correction characteristics of FIG. 6(*a*).

Referring to FIG. 4, symbol ● represents a white chromaticity value at a gray scale level of "3". Symbol ■ represents a white chromaticity value at a gray scale level of "15". Symbol ▲ represents a white chromaticity value at a gray scale level of "23". Symbol ◆ represents a white chromaticity value at a gray scale level of "31". Symbol X represents a white chromaticity value at a gray scale level of "39". Symbol represents a white chromaticity value at a gray scale level of "47". Symbol + represents a white chromaticity value at a gray scale level of "55". Symbol ○ represents a white chromaticity value at a gray scale level of "63".

Referring to FIGS. 5 and 6, symbol ● represents a white chromaticity value before correction and symbol ■ represents a white chromaticity value after correction.

As understood from FIGS. 4 to 6, when the image data is corrected by the FED of the present embodiment, the white balance in each gray scale level of an image displayed on the FED panel 30 can be nearly maintained constant. Moreover, the gray scale characteristic can be linearized.

In this embodiment, the look-up table 33 stores correction data for correcting the R, G, and B data according to the characteristics of a fluorescent substance for each color. Hence, the white balance in each gray scale level of an image displayed on the FED panel 30 can be maintained nearly constant and the gray scale characteristics of the white balance can be linearized.

Since image data is corrected using correction data, the FED panel 30 can display an image faithfully to the image data.

For instance, in the NTSC system, the video signal is subjected to γ correction to match the characteristics of the cathode-ray tube (CRT). However, the FED panel 30 according the present embodiment does not require the γ correction.

For that reason, by previously storing in the look-up table inverse γ correction data for the purpose of removing the γ correction data from the video signals in the NTSC system, video signals can be subjected to the inverse γ correction. In other words, where the characteristics of the FED of the present embodiment are known, the correction can be performed by previously storing γ correction data in the look-up table 33.

Moreover, the case where the look-up table 33 is prepared has been shown in the present embodiment. However, since the luminous characteristics of the FED panel 30 are maintained nearly constant, the correction can be performed through the operation of, for example, an analog arithmetic circuit.

The signal arithmetic circuit such as a CPU (Central Processing Unit) may be prepared instead of the look-up table 33 to change the correction data according to image data.

For instance, a sensor that detects external conditions may be provided. When the surroundings of the FED is, for example, dark, the correction coefficient of correction data may be changed to perform a dimming process for decreasing the brightness of the whole screen, based on the detection information detected by the sensor.

As described above, in the field emission image display according to the present invention, the correction means that can correct image data of each color is provided. Thus, when the drive means display an image on the image display based on image data, the white balance of a display image in each gray scale displayed on the image display can be set to a proper value. As a result, the white balance in each gray scale level can be maintained constant and the gray scale characteristics can be nearly linerized.

When the characteristic such as inverse γ correction is previously known, the correction means stores the correction data so that the correction can be easily performed.

Moreover, according to the present invention, the correction means is configured of a signal processing circuit and the monitor means for monitoring external conditions is prepared. Hence, correction data can be changed according to changes in external environments.

What is claimed is:

1. A field emission image display comprising:

a first substrate on which a plurality of cathode electrodes are formed, each cathode electrode having emitters for field emission;

a second substrate on which anode electrodes are formed, three primary color fluorescent substances being coated on said anode electrodes;

an image display unit for displaying an image when electrons emitted from said emitters impinge on said three primary color fluorescent substances coated on said anode electrodes;

drive means for driving said image display unit; and correction means for correcting image data whereby the white balance of an image displayed on said image display unit is properly set when said drive means drives said image display unit based on said image data;

wherein said correction means comprises an arithmetic circuit that can calculate correction data based on image data, and wherein said correction means comprises a look-up table having correction data which is used to correct said image data to set the brightness level in each gray scale of an image displayed on said image display unit to a predetermined brightness level.

2. A field emission image display comprising:

a first substrate on which a plurality of cathode electrodes are formed, each cathode electrode having emitters for field emission;

a second substrate on which anode electrodes are formed, three primary color fluorescent substances being coated on said anode electrodes;

an image display unit for displaying an image when electrons emitted from said emitters impinge on said three primary color fluorescent substances coated on said anode electrodes;

drive means for driving said image display unit; and correction means for correcting image data whereby the white balance of an image displayed on said image display unit is properly set when said drive means drives said image display unit based on said image data, wherein said correction means comprises an arithmetic circuit that can calculate correction data based on image data; and sensor means for monitoring external conditions, whereby when said correction mans calculates said correction data, the correction coefficient of said correction data is varied based on detection information detected by said sensor means.

* * * * *

UNITED STATES PATENT AND TRADEMARK OFFICE

CERTIFICATE OF CORRECTION

PATENT NO. : 6,329,759 B1
DATED : December 11, 2001
INVENTOR(S) : Tanaka al.

It is certified that error appears in the above-identified patent and that said Letters Patent is hereby corrected as shown below:

Title page,
Item [30], the Foreign Application Priority Data should read:

-- [30] Foreign Application Priority Data
Feb. 17, 1999 (JP) ..... 11-038261 --

Signed and Sealed this

Sixth Day of August, 2002

*Attest:*

*Attesting Officer*

JAMES E. ROGAN
*Director of the United States Patent and Trademark Office*